US007934667B2

(12) United States Patent
Westrich

(10) Patent No.: US 7,934,667 B2
(45) Date of Patent: May 3, 2011

(54) DIFFUSER AND DEVICE FOR PACKAGING AND DISPENSING A FOAMING PRODUCT

(75) Inventor: Caroline Westrich, Paris (FR)

(73) Assignee: L'Oreal, Paris (FR)

( * ) Notice: Subject to any disclaimer, the term of this patent is extended or adjusted under 35 U.S.C. 154(b) by 293 days.

(21) Appl. No.: 11/608,576

(22) Filed: Dec. 8, 2006

(65) Prior Publication Data

US 2007/0131804 A1 Jun. 14, 2007

Related U.S. Application Data

(60) Provisional application No. 60/751,992, filed on Dec. 21, 2005.

(30) Foreign Application Priority Data

Dec. 8, 2005 (FR) ..... 05 12471

(51) Int. Cl.
*B05B 7/32* (2006.01)

(52) U.S. Cl. ..... 239/337; 239/588; 239/589; 239/575; 239/601; 239/567; 222/402.11; 222/490; 222/402.2; 222/402.1

(58) Field of Classification Search ..... 222/192, 222/399, 394, 402.1, 402.12, 402.22, 569, 222/575, 490, 402.16, 402.17; 239/337, 239/588, 601, 565, 589, 579
See application file for complete search history.

(56) References Cited

U.S. PATENT DOCUMENTS 2,612,293 A * 9/1952 Michel ..... 222/182
2,889,086 A * 6/1959 Collins ..... 222/402.22
2,933,222 A * 4/1960 Waldherr ..... 222/402.16
3,169,673 A * 2/1965 Focht ..... 222/182
3,198,394 A * 8/1965 Lefer ..... 222/135
3,511,419 A * 5/1970 Rousselot ..... 222/490
3,887,115 A * 6/1975 Petterson ..... 222/402.13
3,917,121 A 11/1975 Ciaffone
4,239,158 A 12/1980 Gates
4,690,312 A * 9/1987 Crapser et al. ..... 222/402.17
4,694,975 A * 9/1987 Hagan ..... 222/1
4,720,046 A 1/1988 Morane
4,805,839 A * 2/1989 Malek ..... 239/337
4,852,807 A * 8/1989 Stoody ..... 239/337
5,154,328 A * 10/1992 Gueret ..... 222/494
5,263,616 A * 11/1993 Abplanalp ..... 222/402.13
5,340,031 A 8/1994 Nuehaus et al.
5,588,560 A 12/1996 Benedict et al.

(Continued)

FOREIGN PATENT DOCUMENTS

GB 641233 8/1950

(Continued)

*Primary Examiner* — Dinh Q Nguyen
*Assistant Examiner* — Trevor E McGraw
(74) *Attorney, Agent, or Firm* — Oblon, Spivak, McClelland, Maier & Neustadt, L.L.P.

(57) ABSTRACT

A diffuser for a device for packaging and dispensing a product. The arrangement is particularly advantageous for foaming cosmetic products. The diffuser includes a collar which can be mounted on a container and a product diffusion head extending from the collar and provided with at least one output aperture. Preferably, the output aperture is oriented at an angle, relative to an axis of the collar, lying between 0° and 85°. The diffusion head is movable relative to the collar. Moreover, the diffusion head has an extension axis inclined with respect to a longitudinal axis of the collar, and has a size which is contained within the maximum cross-section of the collar and/or of the container.

29 Claims, 3 Drawing Sheets

U.S. PATENT DOCUMENTS

| | | | | | |
|---|---|---|---|---|---|
| 5,597,095 | A | * | 1/1997 | Ferrara, Jr. | 222/402.12 |
| 5,915,597 | A | * | 6/1999 | De Laforcade | 222/182 |
| 5,957,333 | A | * | 9/1999 | Losenno et al. | 222/95 |
| 6,161,735 | A | * | 12/2000 | Uchiyama et al. | 222/402.13 |
| 6,491,187 | B2 | * | 12/2002 | Walters | 222/185.1 |
| 6,547,106 | B2 | * | 4/2003 | Bonningue | 222/213 |
| 6,607,106 | B2 | * | 8/2003 | Henry et al. | 222/402.1 |
| 2002/0056733 | A1 | * | 5/2002 | Lasserre | 222/402.21 |
| 2003/0168476 | A1 | * | 9/2003 | Sanchez | 222/321.7 |

FOREIGN PATENT DOCUMENTS

| | | | |
|---|---|---|---|
| WO | WO9416971 | * | 4/1994 |
| WO | WO 00/12412 | | 3/2000 |
| WO | WO 00/76880 | | 12/2000 |

* cited by examiner

Fig. 2
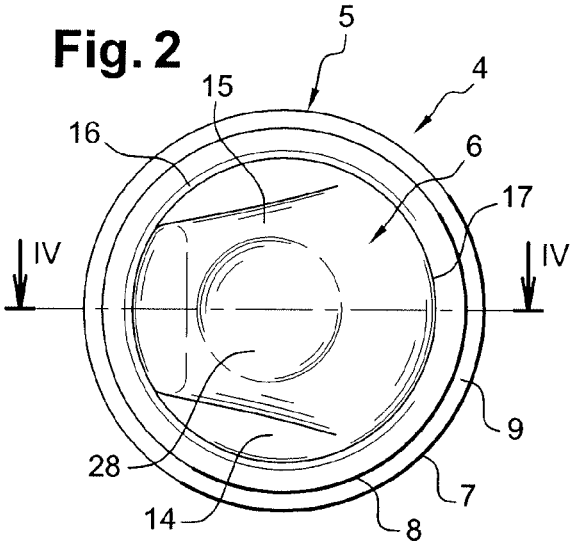
Fig. 3
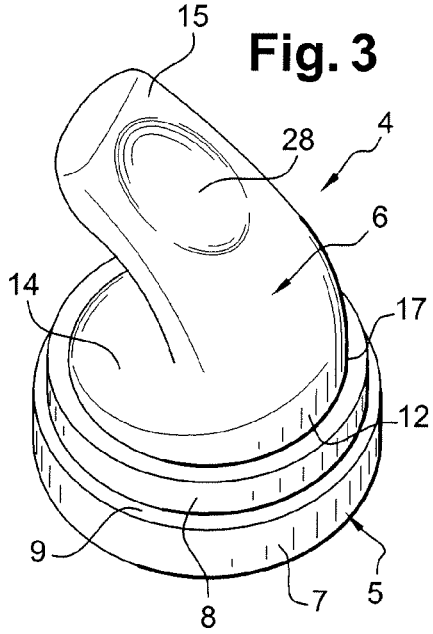
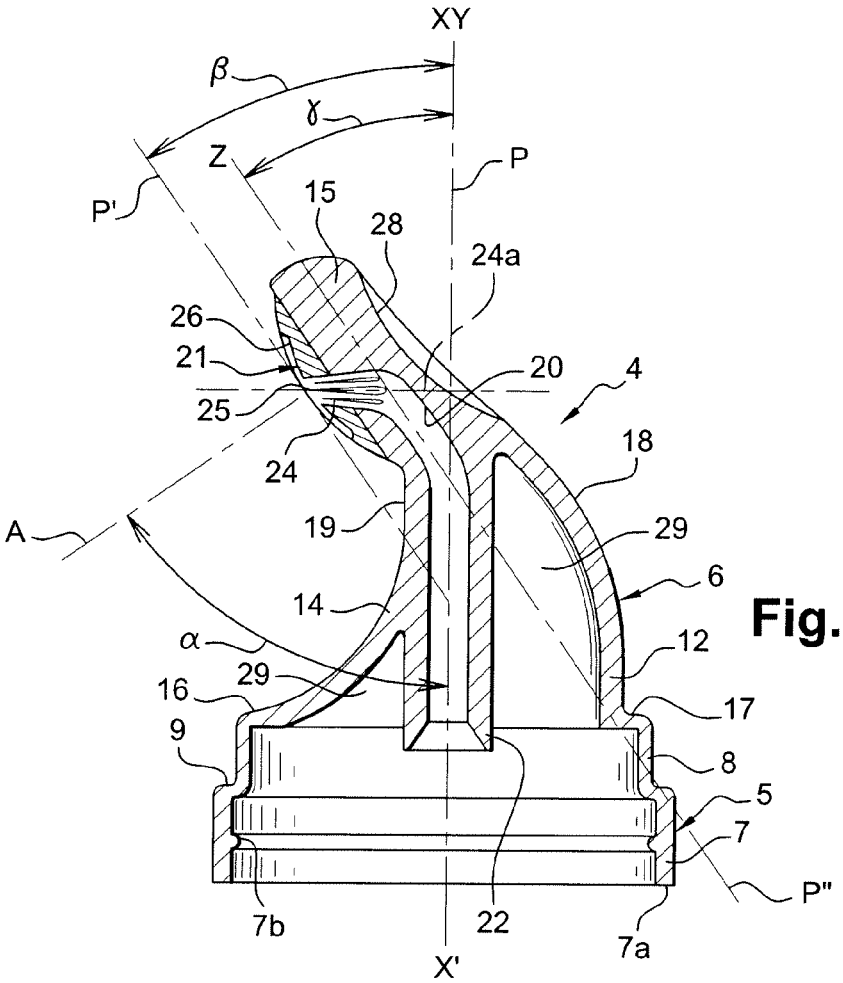
Fig. 4

DIFFUSER AND DEVICE FOR PACKAGING AND DISPENSING A FOAMING PRODUCT

CROSS-REFERENCE TO RELATED APPLICATIONS

This document claims priority to French Application Number 05 12471, filed Dec. 8, 2005 and U.S. Provisional Application No. 60/751,992, filed Dec. 21, 2005, the entire content of which are hereby incorporated by reference.

BACKGROUND OF THE INVENTION

1. Field of the Invention

The invention concerns the field of diffusers for devices for packaging and dispensing a product. The invention can be particularly advantageous for cosmetic products, and more particularly for diffusers for devices for packaging and dispensing a foaming product such as a body cleansing or care cosmetic.

2. Description of Related Art

Packaging and dispensing devices conventionally include a pressurized container containing the product packaged in aerosol form. The container can for example include a valve equipped with a hollow rod for activating the valve in order to allow the controlled dispensing of the product to be applied. The product is generally applied in the form of a foam.

To that end, the known devices include a diffuser which is provided with a collar to allow its fixing on the pressurized container, in particular on the valve seat, and a diffusion head. In order to allow dispensing of the product, the head includes a dispensing channel inside which the hollow output rod of the container fits, and at least one aperture for output of the product connected to the dispensing channel.

The documents U.S. Pat. No. 3,917,121, U.S. Pat. No. 4,239,158, U.S. Pat. No. 4,720,046, WO 00/76880 and GB 641 233 disclose examples of devices of the prior art.

U.S. Pat. No. 4,720,046 describes a diffusion head mounted on a pressurized container and a dispensing channel opening out at an expansion chamber, with a grille for output of the product partly delimiting the expansion chamber. The output grille is provided with the aim of ensuring improved expansion of the foaming product when it is being dispensed.

Through its design, this diffusion head has the drawback of encouraging use of the device either in a substantially horizontal position, or in an upside-down position in which the diffusion head is oriented downwards and is situated under the pressurized container.

Use of the device in these positions is particularly problematic when the container contains a non-miscible two-phase mixture and when the dispensing of the mixture is performed with a dip tube.

Applicant of the present invention has determined that such positions of the device during dispensing of the product generally cause losses of gas from the pressurized container, which can make it unusable after only a few uses. This is because, in these positions, the gas contained inside the container can escape via the dip tube, which generally makes the dispensing of the product remaining in the container impossible or unsatisfactory, the container thus becoming unusable. These losses of gas can thus bring about on the part of consumers a negative assessment of the devices provided with such a diffusion head.

The present invention therefore aims to remedy these drawbacks.

SUMMARY OF THE INVENTION

One object of the invention is therefore, according to a first aspect to provide, a diffuser for a device for packaging and dispensing a foaming product, for example a cosmetic. According to an example, the diffuser includes a collar intended to be mounted on a container and a product diffusion head extending from the collar and provided with at least one output aperture.

Preferably the output aperture is oriented towards an angular sector, considered from the collar, lying in an interval ranging from 0° to 85°. In other words, the axis of the output aperture forms an angle with the overall axis of the diffuser (or an axis of the collar) lying in an interval ranging from 0° to 85°. The output aperture is then, for example, made at a free end of the diffusion head and opens out generally perpendicular to the diffusion head.

According to an example, the diffusion head is able to move relative to the collar. Moreover, the diffusion head has an extension axis inclined with respect to a longitudinal axis of the collar, and has a size which is contained within the maximum cross-section of the collar and/or of the container. The diffusion head may thus have an overall curved and off-centered shape. Nevertheless, the diffusion head does not protrude laterally relative to the collar and/or to the container.

When the diffusion head is contained within the maximum cross-section of the collar, a cap can be fixed on the collar, or directly on the container, without the diffusion head interfering with its positioning.

When the diffusion head extends beyond the maximum cross-section of the collar but remains contained within the maximum cross-section of the container, a cap can be fixed directly on said container without the diffusion head interfering with its positioning.

Moreover, the diffusion head can include, for example, a concave area or surface made between the output aperture and the collar by virtue of which a user can bring his fingers close vertically in line with the aperture so as to collect the dispensed product. This concave surface thus forms a recess allowing the fingers of a user to be positioned underneath the output aperture.

With such a diffuser, it consequently becomes possible to obtain a particularly satisfactory dispensing of the foaming product, even after a large number of uses or activations of the device.

This is because the applicant has determined that such an orientation of the output aperture downwards, combined with the design of the concave surface which allows a user to bring his hand close under the aperture, encourages use of devices provided with such a diffuser in a vertical position in which the diffusion head is situated above the pressurized container.

Thus, the orientation of the output aperture and the configuration of the head allow or compel a user to use the device in this vertical position, which substantially limits the occurrence of problems of losses of gas which are liable to make the device unusable after a reduced number of activations.

Preferably, the output aperture is oriented towards an angular sector considered from the collar lying between approximately 45° and 70°, and more preferably 55°. This is because the applicant has determined that such an orientation of the output aperture allows a particularly satisfactory dispensing of the product and strongly encourages the user to hold the device in a vertical position when dispensing the product.

Advantageously, the diffusion head can be movable angularly with respect to the collar. For example, the diffusion head and the collar are connected by a hinge capable of allowing an angular movement of the diffusion head with respect to the collar so as to reduce the angular sector.

The existence of such a hinge makes it possible to increase the inclination of the output aperture with respect to the longitudinal axis of the diffuser, when it is opposite the output aperture and when the user presses the diffusion head for dispensing the product, which further encourages the use of the dispensing packaging device in an appropriate vertical position.

The diffuser can include a single output aperture and diffusion branches which radiate from the aperture. In a variant, the diffuser can include a plurality of output apertures. Advantageously, according to an example, the output apertures can be arranged so as to provide a diffusion grille.

Preferably, the diffusion head includes a dispensing duct oriented towards an angular sector, considered from the collar, less than 90°.

According to another feature of an example of the invention, the diffusion head includes a contact area for the finger of a user, with the contact area having a concave shape and extending over a face of the head opposite to the concave surface. In a variant, the contact area can also include a raised design, for example ridges or a criss-cross pattern, in order to limit possible skidding or slipping of the finger.

Preferably, the diffuser is made by molding of at least one plastic material, for example. The collar and the head can be advantageously made as a single piece of material such as a one-piece molded part.

According to a second aspect, another object of the invention is a device for packaging and dispensing a foaming product, in particular a cosmetic, including a pressurized container containing the product and a diffuser as defined above, mounted on the container.

Advantageous applications of the invention include the dispensing of a cosmetic product, particularly a foaming product, for example, a medicated or moisturising composition, a shaving or depilatory foam or hair styling mousse, or a hair dye.

As should be apparent, the invention can provide a number of advantageous features and benefits. It is to be understood that, in practicing the invention, an embodiment can be constructed to include one or more features or benefits of embodiments, disclosed herein, but not others. Accordingly, it is to be understood that the preferred embodiments discussed herein are provided as examples and are not to be construed as limiting, particularly since embodiments can be formed to practice the invention that do not include each of the features of the disclosed examples.

BRIEF DESCRIPTION OF THE DRAWINGS

A better understanding of the invention will be gained from reading the following description in conjunction with the accompanying figures. The figures are offered purely as a guide and by way of example, and in no way limit the invention.

FIGS. 2 and 3 are respectively top and perspective views of the diffuser of FIG. 1; and FIG. 4 is a sectional view along the axis IV-IV of FIG. 2;

DETAILED DESCRIPTION OF THE PREFERRED EMBODIMENTS

Figure 1:
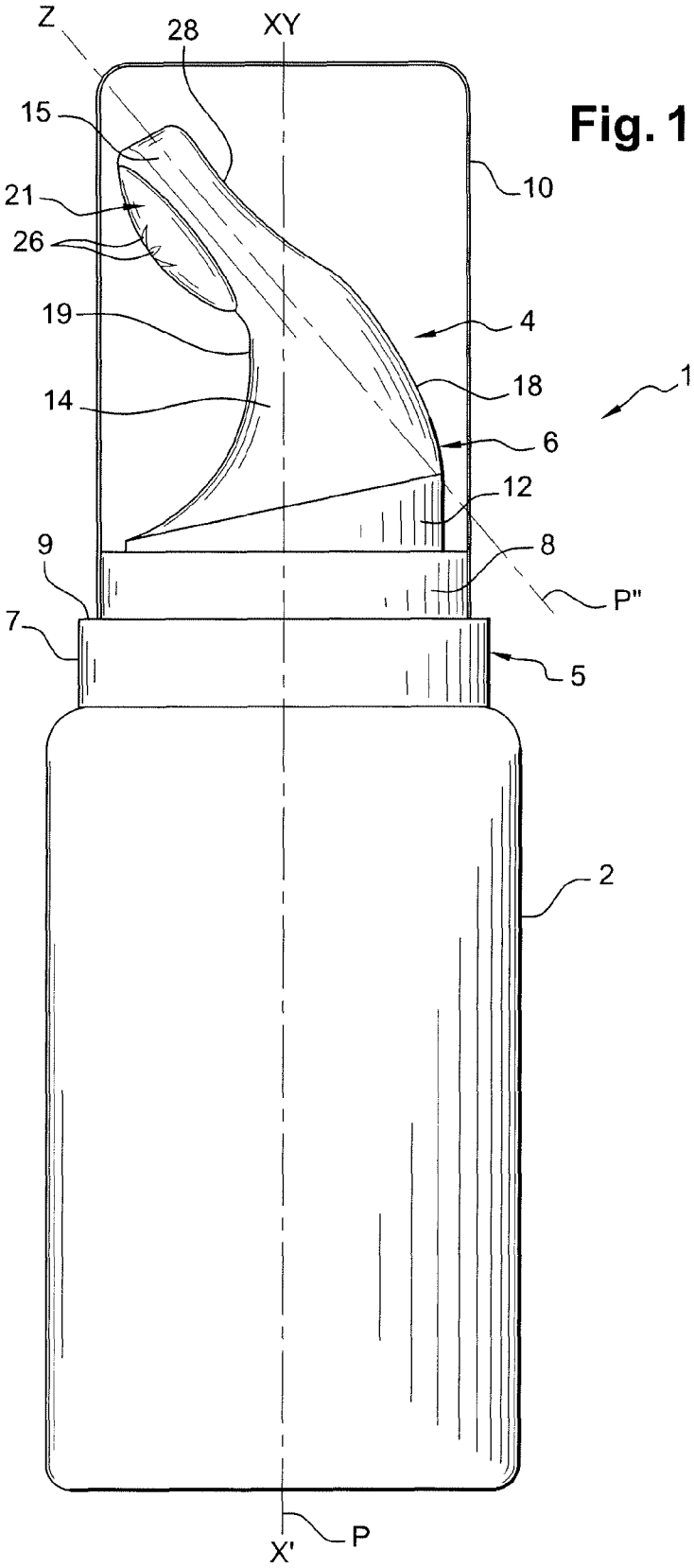
FIG. 1 is a side view of a device for packaging and dispensing a product including a diffuser according to an example of the invention.

Referring now to the drawings, like reference numerals are utilized to designate identical or corresponding parts throughout the several views.

FIG. 1 depicts the general structure of a device for packaging and dispensing a foaming product in accordance with an example of the invention, designated by the overall numerical reference 1, in a position assumed to be vertical.

In the illustrated example, this device is intended for the packaging and dispensing of a cosmetic. However, it can easily be understood that the device can also be applied to the packaging and dispensing of other types of products.

The device 1 includes a pressurized container 2 of overall cylindrical shape, for example, and with an overall axis X-X', and a diffuser 4 mounted at an upper end of the container 2.

The container includes a closed lower end and an open opposite end forming a neck. The container contains the product to be dispensed in aerosol form, and is equipped with a product dispensing valve provided with an activating rod (not depicted) allowing dispensing of product when activated.

The diffuser 4 is intended to allow dispensing of the cosmetic contained in the container 2 in foam form.

As seen in the example of FIGS. 1 to 4, the diffuser 4 includes a collar 5 mounted at the upper end of a valve of the container 2 and a product diffusion head 6, extending from the collar. The diffusion head 6 is mounted such that it is movable with respect to the collar 5.

As shown by FIGS. 1 and 4, the diffusion head 4 has an overall curved shape.

The collar 5 defines a longitudinal axis Y. The collar 5 is coaxial with the axis X-X' of the container 2 in the illustrated example. The collar 5 includes from bottom to top, a first tubular portion 7 provided with a radial annular end surface 7*a* (FIG. 4) forming an edge intended to come to rest on the container 2 or on the valve seat, and a second tubular portion 8 which carries the diffusion head 6.

So as to allow the fixing of the collar 5 on the container 2 or on the valve seat, the tubular portion 7 includes an internal annular flange 7*b* capable of cooperating with a complementary groove (not depicted) made externally on the neck of the container 2, or with a shoulder of the valve seat. Of course, in a variant, making the groove and the flange on the collar and on the neck, respectively, could be provided, or alternate attachment arrangements could be provided.

Figure 5:
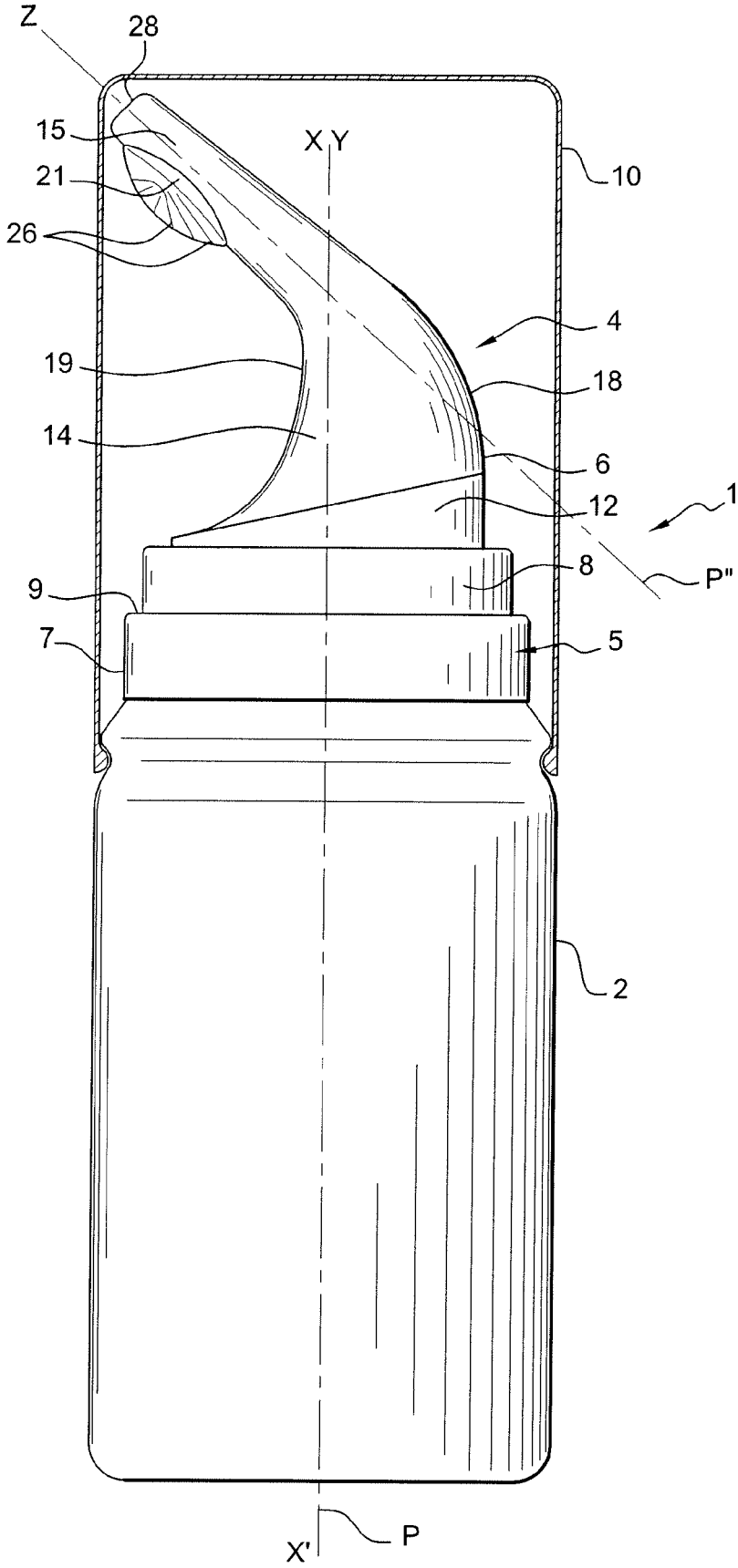
FIG. 5 is a view similar to FIG. 1 of a variant example of an embodiment of a device according to the invention.

The second tubular portion 8 has a diameter substantially smaller than that of the first tubular portion 7 in order to form a radial abutment surface 9 between these first and second tubular portions. This surface 9 is intended to allow the positioning and mounting of a cap 10 on the collar 5 for covering the diffusion head 6. The cap 10 could also be fixed directly on the container 2. In this case, an annular groove can be made externally on the container 2. The cap 10 can then include internally an annular rib capable of being gripped firmly in this groove as depicted in the example of FIG. 5.

The diffusion head 6 is inclined downwards overall. It thus adopts an overall curved shape, but may remain contained within the maximum cross-section of the collar 5 in order to make it possible to position the cap 10 on the collar 5 or on the container 2. Otherwise, as depicted in FIG. 5, when the cap 10 is mounted directly on the container 2, the diffusion head 6 can extend beyond the maximum cross-section of the collar 5 while remaining contained within the maximum cross-section of the container 2.

In the illustrated example, the diffusion head 6 includes a cylindrical portion forming a base 12 on which there is connected, at an upper bevelled surface, a head body 14, itself extended at an upper end by an end area 15 by which the product is dispensed at the output of the head. The diffusion head 6 defines an extension axis Z. The extension axis Z is contained in an extension plane P".

The extension axis Z is inclined with respect to the longitudinal axis Y of the collar 5.

The base 12 is coaxial with the axis X-X', and extends from the tubular portion 8 of the collar 5 axially upwards. In the example, the base 12 has a diameter slightly smaller than that of the tubular portion 8 so as to leave a slight radial gap 16 remaining between them.

In order to allow an angular movement of the diffusion head 6 with respect to the collar 5, the latter is also provided, for example, with a tongue forming a hinge 17 connecting the diffusion head and the base 12 and locally interrupting the gap 16. The tongue 17 thus radially extends towards the inside an upper end of the tubular portion 8 and connects to a lower end of the cylindrical external surface of the base 12.

The hinge 17 has a small angular dimension, here lying between 50° and 70°. Of course, it is also conceivable to provide a tongue having an angular dimension that is substantially different, but however making it possible to obtain a relative angular tilting of the diffusion head 6 with respect to the axis X-X' of the collar 5.

The head body 14 is shaped so as to configure the diffusion head in a curved shape in the example illustrated. To that end, the body includes two rounded surfaces, posterior 18 and anterior 19, which extend the bevelled upper surface of the base 12 upwards, i.e. on the side opposite to the collar 5. The posterior 18 and anterior 19 surfaces have respectively a convex shape and a concave shape. Thus, the radial distance between the axis X-X' and the posterior surface 18 is greater than that between the axis X-X' and the anterior surface 19 so that the body 14 is offset with respect to the collar 5 in the example. The hinge 17 is provided on the posterior surface 18 side of the head body.

As will be described in detail subsequently, the concave anterior surface 19 is shaped so as to define a surface allowing a user to bring his fingers or at least the last phalanx of these fingers close in order to collect the product contained in the container 2.

Regarding the end area 15, this extends from the posterior 18 and anterior 19 surfaces upwards, and is inclined with respect to the axis X-X' of the collar 5. In cross-section the area 15 has an overall rectangular shape, for example.

For dispensing of the product contained inside the container 2, the diffuser 4 also includes a dispensing channel 20 made inside the diffusion head 6. This channel 20 communicates via one end with a diffusion fitting 21 mounted on the anterior surface 19 side.

At its other end, the dispensing channel 20 is connected to the rod for activating the valve (not depicted) of the container 2. This connection is implemented at a central pad 22 of the base 12 which extends axially in the direction of the collar 5.

The valve of the container 2 can be of the type activated either by pushing in or by tilting. It should be noted however that the use of a valve that can be activated by tilting is also compatible with the embodiment depicted in the figures in which the diffusion head is mounted able to move angularly on the collar.

In the illustrated example, the dispensing channel 20 extends from the pad or skirt 22 at the level of which the product is injected into the head 6, then continues axially along the axis X-X', then includes a bent portion, itself continued by a substantially horizontal portion opening out at a front surface of the end area 15. The front surface extends the anterior surface 19 of the head body 14 upwards and towards the front.

In order to dispense the product outside the diffusion head 6, the diffusion fitting 21 also includes a dispensing duct 24 continuing the channel 20 and extending along an axis 24*a*. The dispensing duct 24 opens out at a cylindrical output aperture 25 in the example.

So as to allow better expansion of the foaming product contained inside the pressurized container 2, the diffusion fitting 21 also includes a plurality of dispensing branches 26 connected to the output aperture 25 and which radiate therefrom. Under these conditions, the foaming product contained inside the container 2 has at the output of the diffusion fitting 21 an overall star shape.

In a variant, it is to be understood that it is also possible to provide other types of diffusion fittings to enable dispensing of the product. For example, in replacement for the dispensing aperture 25 and branches 26, a diffusion grille can be provided so as to also obtain an overall output flow cross-section for the product which is larger than the flow cross-section inside the dispensing duct 20.

In another embodiment, a diffusion head including a plurality of output apertures can be provided, each being connected to the dispensing channel 20.

In another variant embodiment, a single output aperture can be provided. However, with such a design, the expansion of the foaming product at the output of the diffusion fitting 21 would typically not be as good as other embodiments.

So as to avoid or discourage use of the device 1 in a horizontal position, or in an upside-down position in which the diffusion head 6 would be below the container 2, the output aperture 25 is tangential to a plane P' (or has a tangent plane P') which is inclined with respect to a median longitudinal plane of the collar P containing the axis X-X'. The planes P and P' form an angle β in FIG. 4. In other words, as shown in FIG. 4, the output of the diffusion head 6 is oriented downwards and towards the front of the diffuser. More particularly, the axis A of the output aperture 25, which corresponds to the direction in which the product is dispensed, is oriented according to an angular sector α lying in an interval ranging from 0° to 85°, considered from the axis X-X' of the collar 5. When the angle between the axis A and the axis X-X' is zero, the axis A is parallel to the axis X-X' while being situated at a distance therefrom.

The plane P" is inclined with respect to the plane P. The plane P" can be parallel to the plane P'. The planes P and P" can define an angle γ identical, similar or different from the angle defined between the planes P and P'.

In fact, the applicant has determined that this orientation of the output aperture 25 in this angular sector encourages the user of the device 1 to keep it in a vertical position during its use. In this position, in which the diffusion head 6 is above the container 2, the risk of losses of gas from the container 2 is substantially reduced, and the reliability of use of the device 1 is increased.

Preferably, in order to obtain a diffusion head 6 having ergonomics particularly encouraging the use of the device 1 in this vertical position, the applicant has also determined that it is advisable or preferable to provide an inclination of the axis A with respect to the axis X-X' lying between 45° and 70°, and preferably equal to 55°. Under these conditions, the inclination of the plane P with respect to the plane P' lies between 20° and 45°, and is advantageously equal to 35°.

Regarding the axis 24*a* of the dispensing duct 24, this extends here substantially perpendicular with respect to the axis X-X' in the illustrated example. However, the applicant has determined that an angular orientation of the dispensing duct 24 so that an angle formed between the axis 24*a* and the axis X-X' is less than 90° in order to obtain a dispensing duct 24 oriented downwards is particularly advantageous for dispensing the product, in particular in the case of a non-foaming product.

In order to further increase the ergonomics of the diffusion head 6, the head can also include a concave contact area 28 for the finger of a user which is made at the head 15, on the side opposite to the diffusion fitting 21 (FIG. 3). This contact area 28 could also have a domed or convex shape. It could also be ribbed or ridged.

When a user exerts a pressure on this contact area 28 in order to dispense a product, the diffusion head 6, by virtue of the existence of the hinge 17, tilts slightly with respect to the collar 5, which further increases the angle β formed between the planes P and P' thus encouraging use of the container 2 in an appropriate vertical position of the device. Such a hinge associated with a diffusion head avoids the user having to tip up the device in order to correctly collect the product in his hand which provides better operation of the device.

Moreover, the presence of an anterior surface 19 situated below the output aperture 21 and designed so as to allow a user to position his hand below this aperture also further encourages use of the device in a vertical position, in which the diffusion head 6 is above the container 2.

This is because the anterior surface 19 forms a recess capable of allowing, through its shape and dimensions, the positioning of the fingers of the user below the output aperture 21 in this vertical position of the device 1.

Thus, by virtue of the presence of the concave anterior surface 19 and the posterior contact surface 28 and by virtue of the curved shape of the dispensing head, the user is naturally led to use the dispensing device in the appropriate vertical position. First, he or she takes hold of the container 2 in the palm of one of their hands, and then activates the diffuser by pressing with their forefinger, or their thumb, on the contact area 28. The contact surface 28 and the output aperture 25 can extend on either side of the plane P". The dispensing of the product contained in the container 2 can thus be obtained in a unique side of the dispensing head, the opposite side forming an actuating surface for triggering such a dispensing.

Simultaneously with the activation of the diffuser, the user collects the product with their second hand which they have previously brought close by bringing the phalanges in contact against the concave anterior surface 19, so as to be vertically in line with the output aperture 25.

The angular orientation of the plane P' containing the output aperture with respect to the median plane P of the collar 5 combined with the curved design of the head body 14 consequently encourages the user to use the device in a position limiting the phenomena of loss of gas from the pressurized container 2, which makes it possible to obtain product dispensing which is satisfactory over time.

So as to obtain a diffuser 4 that is particularly economical to produce, the diffusion head 6 can also include an annular recess 29 made at the level of the body 14 and surrounding the pad 22 or end 22. In addition, the collar 5 and the diffusion head 6 of the diffuser 4 can be advantageously formed, for example, by molding a synthetic material, for example polypropylene, and are preferably molded in a single piece.

By way of example, the diffusion fitting 21 is advantageously added onto the diffusion head 6, for example by clipping or snapping in place or other attachment methods, as depicted in FIG. 4.

There is thus provided a diffusion head 4 forming a unitary assembly that is easy to transport, handle and package.

In a variant of the diffusion fitting, a diffuser produced in one piece could also be provided, for example, by injection molding a plastic material.

Regarding the cap 10, this is for example produced from a molded synthetic material. It is preferably transparent to daylight or translucent, for example. An opaque cap could however, of course, also be used.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A diffuser for a device for packaging and dispensing a foaming product, comprising;

a collar mounted above a container, said collar having a longitudinal axis;

a product diffusion head extending from the collar and including at least one output aperture through which the foaming product exits the device; and a beveled surface mounted above the collar that increases in area from a front side of the diffusion head including the output aperture to a back side thereof, wherein the diffusion head is movable relative to the collar such that, at each position of the diffusion head, an axis of the output aperture is oriented downward towards a bottom of the container at an angular sector within a range from 0 to 85 degrees from a direction parallel to the longitudinal axis of the collar, and wherein said diffusion head is movable relative to the collar such that the diffusion head is contained within a maximum cross-section of the collar and/or of the container as measured orthogonal to the longitudinal axis of the collar.

2. The diffuser according to claim 1, wherein the diffusion head includes:

a concave surface provided between the output aperture and the collar to allow fingers of a user to be positioned underneath the output aperture.

3. The diffuser according to claim 1, wherein the range is from 45 to 70 degrees.

4. The diffuser according to claim 3, wherein the range is 55 degrees.

5. The diffuser according to claim 1, wherein the diffusion head is movable angularly with respect to the collar.

6. The diffuser according to claim 5, wherein the diffusion head and the collar are connected by a hinge allowing the angular movement of the diffusion head with respect to the collar and wherein the angular movement of the diffusion head from a rest position reduces the angle between the output aperture and the axis of the collar.

7. The diffuser according to claim 1, wherein the output aperture is provided at a free end of the diffusion head, and a hinge connects a connected end of the diffusion head to the collar.

8. The diffuser according to claim 7, wherein the output aperture opens out in a direction generally perpendicular to the diffusion head.

9. The diffuser according to claim 1, wherein the diffusion head includes a single output aperture and a plurality of diffusion branches which radiate from said single output aperture.

10. The diffuser according to claim 1, comprising a plurality of output apertures.

11. The diffuser according to claim 10, wherein the output apertures are arranged so as to form a diffusion grille.

12. The diffuser according to claim 1, wherein the diffusion head comprises a dispensing duct oriented at an angle, relative to the longitudinal axis of the collar, which is less than 90°.

13. The diffuser according to claim 2, wherein the diffusion head comprises a contact area for one of the fingers of the user, the contact area having a concave shape and extending over a face of the head opposite to the concave surface.

14. The diffuser according to claim 1, wherein the diffuser is molded of at least one plastic material.

15. The diffuser according to claim 14, wherein the collar and the diffusion head are a single piece of material.

16. The diffuser according to claim 1, in combination with a pressurized container containing a cosmetic product, wherein the diffuser is mounted on the container.

17. The diffuser and container according to claim 16, wherein the diffusion head does not project radially beyond an outer diameter of said container at each position of the diffusion head.

18. The diffuser and container according to claim 17, wherein a concave surface is provided between the output aperture and the collar to allow at least one finger of a user to be positioned underneath the output aperture to collect the foaming product exiting the output aperture, the concave surface is configured to allow the at least one finger of the user to be partially enveloped by the concave surface.

19. The diffuser and container according to claim 18, wherein the diffusion head does not project radially beyond an outer diameter of said collar.

20. The diffuser and container according to claim 18, wherein the container contains a foamable product.

21. A diffuser and container assembly, comprising:

a container containing a product, said container having an outer diameter;

a diffuser mounted on said container, the diffuser comprising:

a collar coupled to the container, the collar including:

a first tubular portion concentric to the container and having a first annular radially-outwardly-facing surface, a second tubular portion concentric to the container and having a second annular radially-outwardly-facing surface, a diameter of the second annular-radially-outwardly-facing surface smaller than the first annular-radially-outwardly-facing surface, and a radial abutment surface between the first tubular portion and the second tubular portion, the radial abutment surface configured to interface with a cap, the cap configured to cover a diffusion head; and the diffusion head extending from the collar, said diffusion head including:

a base, and an output aperture arranged such that when said container is in a vertical position a flow of the product exiting said output aperture is directed in a downwards direction, the diffusion head being connected by a hinge to the second tubular portion, wherein said diffusion head is movable relative to the collar such that, at each position of the diffusion head, an axis of the output aperture is oriented downwards towards a bottom of the container at an angular sector within a range from 0 to 85 degrees from a direction parallel to a longitudinal axis of the collar, and wherein the base includes a beveled surface mounted above the collar that increases in area from a front side of the diffusion head including the output aperture to a back side thereof.

22. The assembly according to claim 21, wherein a concave surface is provided between said output aperture and said collar to allow at least one finger of a user to be positioned under said output aperture to collect product exiting said output aperture, the concave surface is configured to allow the at least one finger of the user to be partially enveloped by the concave surface, and wherein a flow of product exiting said output aperture is directed downward to a location at least partially within an outer diameter of said container.

23. The assembly according to claim 22, wherein said diffusion head does not radially project beyond an outer diameter of said collar.

24. The assembly according to claim 22, wherein said container contains a foam product.

25. The assembly according to claim 22, wherein said container contains a cosmetic product.

26. The diffuser according to claim 1, wherein at each position of the diffusion head, the diffusion head is contained within a maximum cross-section of the collar and/or of the container as measured orthogonal to the longitudinal axis of the collar.

27. The diffuser according to claim 21, wherein said diffusion head does not radially project beyond an outer diameter of the container at each position of the diffusion head.

28. The diffuser according to claim 1, wherein the diffusion head is contained within a maximum cross-section of the collar and/or of the container as measured orthogonal to the longitudinal axis of the collar when an actuator of the diffuser is not activated.

29. The diffuser according to claim 21, wherein said diffusion head does not radially project beyond an outer diameter of the container when an actuator of the diffuser is not activated.

* * * * *